US009940916B2

(12) United States Patent
Suzuki

(10) Patent No.: US 9,940,916 B2
(45) Date of Patent: Apr. 10, 2018

(54) KEY GUIDE STRUCTURE FOR KEYBOARD INSTRUMENT

(71) Applicant: KABUSHIKI KAISHA KAWAI GAKKI SEISAKUSHO, Hamamatsu-shi, Shizuoka-ken (JP)

(72) Inventor: Akihiro Suzuki, Hamamatsu (JP)

(73) Assignee: KABUSHIKI KAISHA KAWAI GAKKI SEISAKUSHO, Shizuoka-Ken (JP)

( * ) Notice: Subject to any disclaimer, the term of this patent is extended or adjusted under 35 U.S.C. 154(b) by 0 days.

(21) Appl. No.: 15/459,359

(22) Filed: Mar. 15, 2017

(65) Prior Publication Data

US 2017/0278498 A1 Sep. 28, 2017

(30) Foreign Application Priority Data

Mar. 22, 2016 (JP) ..... 2016-057223

(51) Int. Cl.
*G10H 1/32* (2006.01)
*G10H 3/00* (2006.01)
*G10H 1/34* (2006.01)

(52) U.S. Cl.
CPC ..... *G10H 1/34* (2013.01); *G10H 2220/265* (2013.01)

(58) Field of Classification Search
CPC ..... G10H 1/34; G10H 2220/265
USPC ..... 84/744
See application file for complete search history.

(56) References Cited

U.S. PATENT DOCUMENTS 3,693,492 A * 9/1972 Ohno ..... G10C 3/12 84/436
5,495,074 A * 2/1996 Kondo ..... G10H 1/0558 84/690
5,796,023 A * 8/1998 Kumano ..... G10C 3/12 84/433
5,929,357 A * 7/1999 Masubuchi ..... G10C 3/12 235/145 R
5,932,825 A * 8/1999 Kumano ..... G10C 3/16 84/423 R
2007/0221042 A1* 9/2007 Watanabe ..... G10C 3/12 84/436

(Continued)

FOREIGN PATENT DOCUMENTS

JP 2015-81930 4/2015

*Primary Examiner* — Jeffrey Donels
(74) *Attorney, Agent, or Firm* — Lewis Roca Rothgerber Christie LLP

(57) ABSTRACT

A key guide structure for a keyboard instrument, which is capable of stably and appropriately guiding a key pivotally moved by key depression without generating noise. The key guide structure has guide holders each erected below a guide recess of each key, and guide members mounted to tops of the guide holders, respectively, each for sliding contact with lateral inner side surfaces of the recess. Each guide member includes a body disposed between the lateral inner side surfaces of the recess with a predetermined clearance, two lateral flexible portions laterally flexible and extending from lateral ends of a front or rear surface of the body in a manner protruding in a front-rear direction, and two lateral contact portions which are provided at front ends of the flexible portions in a manner protruding sideward and are in contact with the lateral inner side surfaces of the recess.

4 Claims, 6 Drawing Sheets

(56) References Cited

U.S. PATENT DOCUMENTS

| | | | | |
|---|---|---|---|---|
| 2008/0121091 | A1* | 5/2008 | Toyama | G10C 3/12 84/436 |
| 2015/0122108 | A1* | 5/2015 | Takata | G10H 1/346 84/433 |

* cited by examiner

KEY GUIDE STRUCTURE FOR KEYBOARD INSTRUMENT

CROSS-REFERENCE TO RELATED APPLICATION(S)

This application claims priority of Japanese Patent Application Number 057223/2016, filed on Mar. 22, 2016, the entire content of which is incorporated herein by reference.

BACKGROUND OF THE INVENTION

Field of the Invention

The present invention relates to a key guide structure for a keyboard instrument, which is applied to a keyboard instrument, such as an electronic piano, and configured to guide a key pivotally moved by key depression.

Description of the Related Art

Conventionally, the present applicant has already proposed a key guide structure for a keyboard instrument e.g. in Japanese Laid-Open Patent Publication (Kokai) No. 2015-81930. In this key guide structure, a key having a rear end thereof pivotally supported is formed with a guide recess opening downward, and below the guide recess, there is erected a key guide holder having a key guide body mounted on an upper end thereof. The key guide body is made of elastomer and is formed in a plate shape having a lateral width substantially equal to a distance between left and right guide walls of the guide recess. The key guide body has a lubricant, such as grease, applied to left and right side surfaces thereof.

In the above-described key guide structure, when a key is in a key-released state, an upper end of the associated key guide body is engaged with the inside of the guide recess of the key in a state slightly inserted therein. In this state, when the key is depressed, the key guide body is deeply inserted into the guide recess while being held in sliding contact with the left and right guide walls of the guide recess, to thereby guide the key being pivotally moved while preventing the key from swinging in the left-right direction, i.e. while preventing lateral swing of the key.

However, since the key guide body is formed to have a lateral width substantially equal to the distance between the left and right guide walls of the guide recess of the key, friction between the key guide body and the left and right guide walls of the guide recess can be increased due to variation in manufacturing or mounting of the key guide body, and further depending on environment (temperature and humidity) in which the associated keyboard instrument is used. In this case, when the key is depressed, the touch weight of the key can be made larger than necessary or returning motion of the depressed key can be made slow. By securing a clearance between the left and right side surfaces of the key guide body and the respective left and right guide walls of the guide recess, it is possible to solve the above-mentioned problem caused by increased friction, but depending on the size of the clearance, it is sometimes impossible to sufficiently prevent the lateral swing of the key. Further, in this case, when a lateral force acts on the key during key depression to bring the guide wall of the guide recess into contact with the key guide body, there is a possibility that noise is generated or even a possibility that the key is brought into contact with a key adjacent thereto. Thus, the conventional key guide structure leaves room for improvement.

SUMMARY OF THE INVENTION

It is an object of the present invention to provide a key guide structure for a keyboard instrument, which is capable of stably and appropriately guiding a key pivotally moved by key depression, without generating noise.

To attain the above object, the present invention provides a key guide structure for a keyboard instrument including a plurality of keys each of which extends in a front-rear direction with a rear end thereof pivotally supported on a keyboard chassis and with a guide recess opening downward, the key guide structure being provided for guiding each key pivotally moved by key depression, the key guide structure including a plurality of key guide holders each erected on the keyboard chassis, in association with each key, at a location below the guide recess, and a plurality of key guide members mounted to upper portions of the key guide holders, respectively, each for being brought into sliding contact with left and right inner side surfaces of the guide recess, wherein each of the key guide members comprises a key guide body formed in a plate shape which is rectangular in front view and has a predetermined thickness, the key guide body being disposed between the left and right inner side surfaces of the guide recess with a predetermined clearance from each of the left and right inner side surfaces, two left and right flexible portions which are flexible in a left-right direction and extend from respective left and right ends of one of a front surface and a rear surface of the key guide body in a manner protruding in the front-rear direction, and two left and right contact portions which are provided at front ends of the flexible portions in a manner protruding sideward therefrom, and are in contact with the left and right inner side surfaces of the guide recess.

According to the construction of the key guide structure, the plurality of keys extending in the front-rear direction each has the guide recess opening downward and has the rear end thereof pivotally supported on the keyboard chassis. Further, the plurality of key guide holders are each erected on the keyboard chassis, in association with each key, at a location below the guide recess, and the plurality of key guide members are mounted to the upper portions of the key guide holders, respectively.

Each key guide member has the key guide body formed in a plate shape which is rectangular in front view and has a predetermined thickness, and the key guide body is disposed between the left and right inner side surfaces of the guide recess with a predetermined clearance from each of the left and right inner side surfaces. Further, one of the front surface and the rear surface of the key guide body is provided with the two left and right flexible portions which extend from respective left and right ends thereof in a manner protruding in the front-rear direction, and the two left and right contact portions, which are provided at the front ends of the flexible portions in a manner protruding sideward therefrom, are in contact with the left and right inner side surfaces of the guide recess. That is, the contact portions provided at the front ends of the flexible portions of the key guide member are always in contact with the respective left and right inner side surfaces of the guide recess with appropriate friction and with a relatively weak force. This makes it possible to suppress generation of noise more effectively than in a case where the left and right inner side surfaces of the guide recess of the key are directly brought into contact with the key guide body of the key guide member during key depression. Further, even when the contact portion of the key guide member is pressed by the associated inner side surface of the guide recess of the key during key depression due to variation in manufacturing or mounting of the key guide member, the associated flexible portion warps to thereby prevent large friction from being caused between the inner side surface of the guide recess and the contact portion of the key guide member. This makes it possible to ensure smooth pivotal motion of the key and stably and properly guide the key.

Preferably, the key guide member is made of a soft synthetic resin, and each of the flexible portions is formed in a thin wall shape having a predetermined thickness in the left-right direction.

According to the construction of this preferred embodiment, in the key guide member made of a soft synthetic resin, by forming each of the flexible portions in a thin wall shape having a predetermined thickness in the left-right direction, it is possible to easily form the flexible portion having flexibility in the left-right direction.

Preferably, each of the flexible portions and each of the contact portions are formed in a manner extending vertically, and each of the contact portions is configured to be capable of being in contact with the inner side surface of the guide recess over a whole vertical length thereof.

According to the construction of this preferred embodiment, the left and right flexible portions and the left and right contact portions of each key guide member are formed in a manner extending vertically, and each contact portion is configured to be capable of being in contact with the inner side surface of the guide recess over a whole vertical length thereof. That is, each contact portion comes into substantial line contact with the inner side surface of the guide recess, and hence, it is possible not only to suppress friction by minimizing a contact area between the two, but also to cause, when the contact portion is pressed, the associated flexible portion to easily warp in a well-balanced manner.

The above and other objects, features, and advantages of the present invention will become more apparent from the following detailed description taken in conjunction with the accompanying drawings.

DETAILED DESCRIPTION OF PREFERRED EMBODIMENTS

Figure 1:
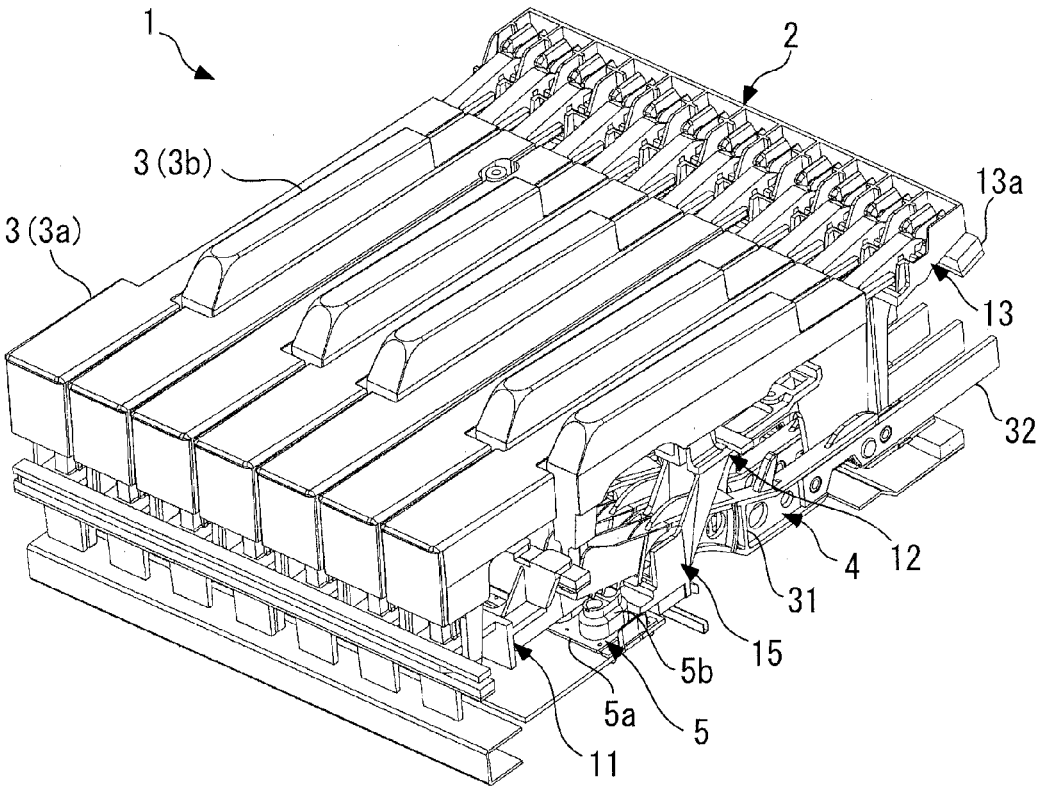
FIG. 1 is a perspective view of a keyboard device (one octave section thereof) of an electronic piano to which is applied a key guide structure according to an embodiment of the present invention.
Figure 2A:
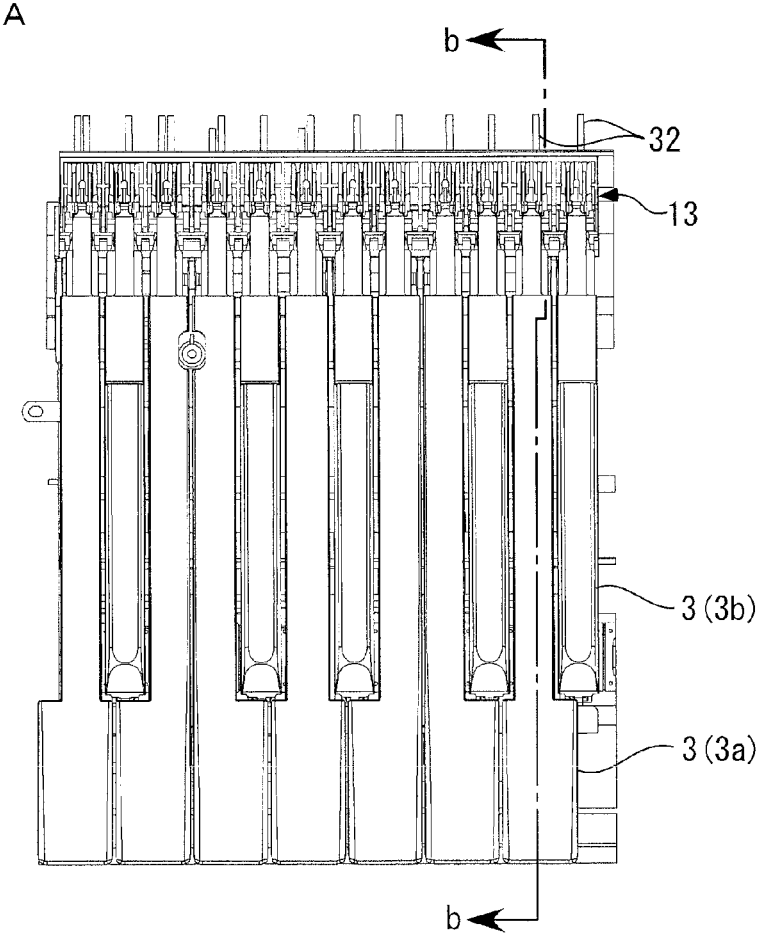
FIG. 2A is a plan view of the keyboard device shown in FIG. 1.
Figure 2B:
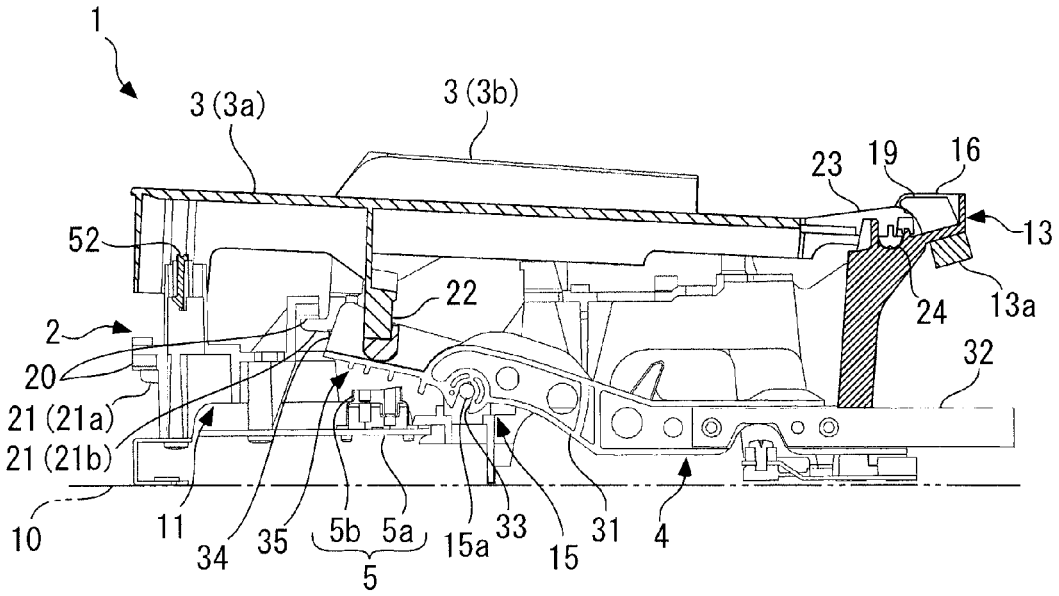
FIG. 2B is a cross-sectional view taken on line b-b of FIG. 2A.

The present invention will now be described in detail with reference to the drawings showing a preferred embodiment thereof. FIGS. 1, 2A, and 2B show a keyboard device, in a key-released state, of an electronic piano to which is applied a key guide structure according to the embodiment. Note that FIGS. 1, 2A, and 2B show only a one-octave section of the keyboard device.

As shown in FIGS. 1, 2A, and 2B, the keyboard device 1 is comprised of a keyboard chassis 2, a plurality of keys 3 including white keys 3*a* and black keys 3*b* pivotally mounted on the keyboard chassis 2 and arranged in the left-right direction, a plurality of hammers 4 pivotally mounted on the keyboard chassis 2 in association with the keys 3, respectively, and a key switch 5 for detecting key depression information on the keys 3.

Figure 3A:
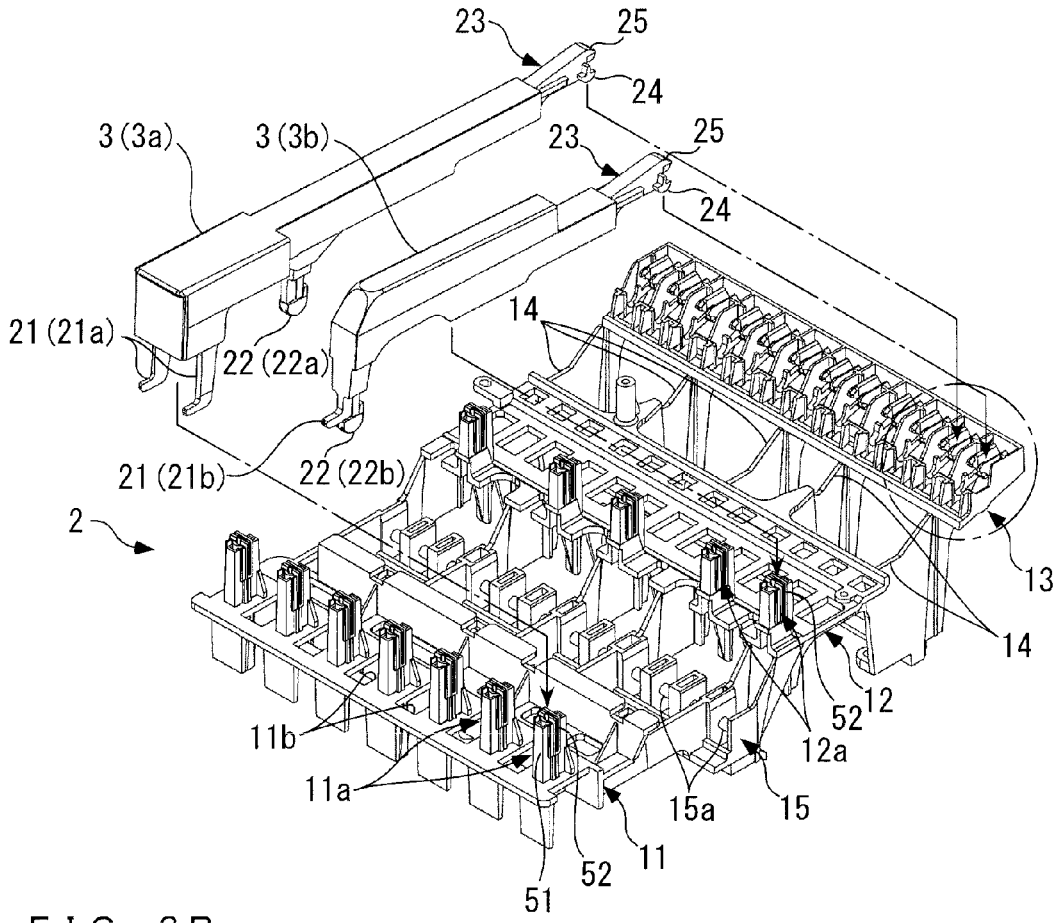
FIG. 3A is an exploded perspective view of a keyboard chassis and keys of the keyboard device in FIG. 1.

The keyboard chassis 2 is formed as a resin molded article which is made e.g. by injection molding of a predetermined resin material (e.g. an ABS resin) into a predetermined shape. As shown in FIG. 3A, the keyboard chassis 2 has a front part 11, a central part 12, and a rear part 13, each extending in the left-right direction as a whole. The front part 11, the central part 12, and the rear part 13 are connected to each other by a plurality of ribs 14 disposed with an appropriate spacing therebetween in the left-right direction. Note that in the following description, the front part 11, the central part 12, and the rear part 13 of the keyboard chassis 2 will be referred to as "the chassis front 11", "the chassis center 12", and "the chassis rear 13", respectively.

The chassis front 11 serves to guide the white keys 3*a*. The chassis front 11 has a plurality of (seven in FIG. 3A) white key guide parts 11*a* erected thereon and each inserted into an associated one of the white keys 3*a* from below so as to prevent lateral swing of the white key 3*a*. Further, the chassis front 11 has engagement holes 11*b* and 11*b*, vertically extending therethrough, formed on the left and right sides of each of the white key guide parts 11*a*, respectively. A pair of left and right upper limit position regulation parts 21*a* and 21*a*, referred to hereinafter, of the white key 3*a* are engaged with the respective engagement holes 11*b* and 11*b* in a state inserted therethrough.

The chassis center 12 serves to guide the black keys 3*b*. Similar to the chassis front 11, the chassis center 12 has a plurality of (five, in FIG. 3A) black key guide parts 12*a* erected thereon and each inserted into an associated one of the black keys 3*a* from below so as to prevent lateral swing of the black key 3*b*. Further, at a location forward of the chassis center 12, there is disposed a hammer support part 15 for supporting the hammers 4. The hammer support part 15 has a plurality of support shafts 15*a* extending along a single straight line extending in the left-right direction, and the hammers 4 are pivotally supported by the support shafts 15*a*, respectively.

Further, between the hammer support part 15 and the chassis front 11, there is mounted the key switch 5. As shown in FIGS. 1 and 2B, the key switch 5 is comprised of a laterally elongated printed circuit board 5*a* extending in the left-right direction and a plurality of switch bodies 5*b* each formed by a rubber switch and mounted on the printed circuit board 5*a* in association with each key 3.

Figure 3B:
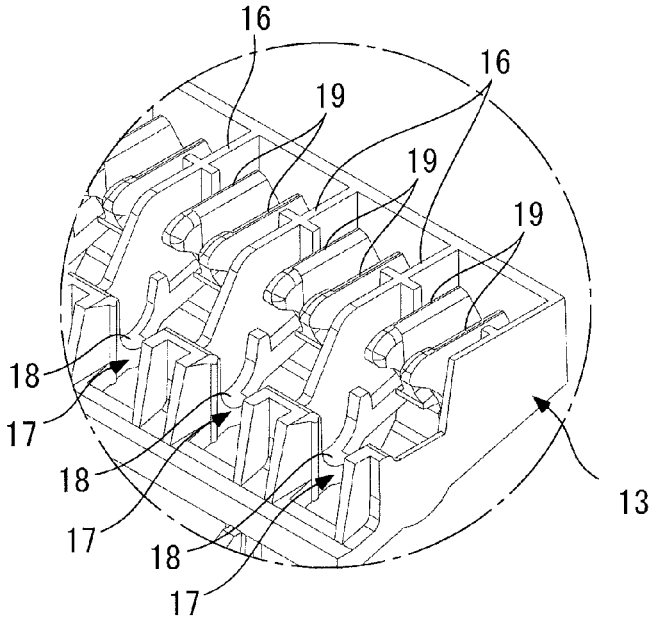
FIG. 3B is a partially enlarged perspective view of a rear end of the keyboard chassis.

The chassis rear 13 serves to support the keys 3 by their rear ends such that the keys 3 can pivotally move in the vertical direction. As shown in FIG. 3B, the chassis rear 13 is provided with a plurality of partition walls 16 which are formed with a predetermined spacing therebetween in the left-right direction such that adjacent keys 3 and 3 are separated from each other. Further, between each pair of adjacent ones of the partition walls 16 and 16, there is formed a predetermined key support part 17 having a laterally symmetrical shape and configured to pivotally support an associated one of the keys 3. Specifically, the key support part 17 has left and right lower support portions 18 and 18 (only the left one of which is shown in FIG. 3B) for supporting, from below, respective left and right pivot shafts 24 and 24, referred to hereinafter, and a pair of left and right upper support portions 19 and 19 for supporting, from above, a portion of a rear end of the key 3 extending from the upper surface of the key 3 to the rear surface thereof.

The key 3 is formed e.g. by injection molding of a predetermined resin material (e.g. an AS resin) into a hollow shape which extends over a predetermined length in a front-rear direction and opens downward. As shown in FIG. 3A, the white key 3*a* has a front end thereof formed with the pair of left and right upper limit position regulation parts 21 (21*a*) which protrude downward from respective side walls of the front end of the white key 3*a* and each having a lower end thereof bent forward. The upper limit position regulation parts 21 (21*a*) are engaged with the respective left and right engagement holes 11*b* and 11*b* in a state inserted therethrough. Further, the white key 3*a* has an actuator part 22 (22*a*), which protrudes downward, formed at a predetermined location rearward of the upper limit position regulation parts 21*a*. The actuator part 22 (22*a*) is engaged with an engagement recess 34, referred to hereinafter, of the hammer 4 in a state received therein. On the other hand, the black key 3*b* has a front end thereof formed with an upper limit position regulation part 21 (21*b*) and an actuator part 22 (22*b*), which have the same functions as those of the upper limit position regulation parts 21 (21*a*) and the actuator part 22 (22*a*) of the white key 3*a*.

As shown in FIG. 3A, the key 3 has a rear part including a rear body 23 formed such that it has a smaller width than that of part of the key 3 forward thereof and extends in the front-rear direction. The pivot shafts 24 and 24, which protrude outward (i.e. leftward and rightward, respectively), are formed on the left and right side surfaces (only the right side surface of which is shown in FIG. 3A) of the rear body 23 at respective predetermined locations close to a rear end of the rear body 23. Each of the pivot shafts 24 and 24 has a lower half formed to have an arcuate surface and is in a semicircular shape in side view. Further, the rear end of the rear body 23 is formed such that a curved surface 25 with a predetermined curvature extends from the upper surface to the rear surface of the rear body 23. The curved surface 25 is formed to be convexly curved along a concentric circle about the pivot shaft 24 of the key 3 in side view.

As shown in FIG. 2B, the hammer 4 is comprised of a hammer body 31 extending in the front-rear direction (i.e. in the left-right direction as viewed in FIG. 2B) and two weights 32 and 32 (only the right one of which is shown) attached to the respective right and left side surfaces of the rear part of the hammer body 31 and extending in the front-rear direction. The hammer body 31 is made of a predetermined synthetic resin (e.g. polyacetal), and is pivotally engaged with the support shaft 15*a* of the hammer support part 15 of the keyboard chassis 2 via a bearing portion 33 provided at a predetermined location in a front part thereof. Further, the engagement recess 34 for engagement with the actuator part 22 of the key 3 is formed in the front part of the hammer body 31 at a location forward of the bearing portion 33, and a switch pressing portion 35 formed below the engagement recess 34, for pressing the associated switch body 5*b* of the key switch 5.

The weights 32 are made of a material (metal such as iron) larger in specific gravity than the hammer body 31, and are formed as two elongated and narrow plates. The two weights 32 and 32 are fixed to the hammer body 31 in a state sandwiching the rear part of the hammer body 31.

In the keyboard device 1 constructed as above, when the key 3 is depressed in the key-released state shown in FIGS. 1 and 2B, the key 3 pivotally moves downward about the left and right pivot shafts 24 and 24 of the rear end of the key 3. In accordance with this pivotal motion of the key 3, the actuator part 22 of the key 3 presses downward the engagement recess 34 of the front part of the hammer 4. As a consequence, the hammer 4 presses the associated switch body 5*b* of the key switch 5 from above by the switch pressing portion 35 while pivotally moving in the counterclockwise direction, as viewed in FIG. 2B, about the support shaft 15*a* of the hammer support part 15. In this case, the rear end of the hammer 4 is brought into abutment with a hammer stopper 13*a* of the chassis rear 13 from below, whereby further pivotal motion of the hammer 4 is inhibited.

On the other hand, when the depressed key 3 is released, the hammer 4 pivotally moves in a direction opposite to the above-mentioned direction. In accordance with this pivotal motion of the hammer 4, the key 3 is pushed upward via the actuator part 22, thereby being pivotally moved upward. As a consequence, the key 3 and the hammer 4 return to their key-released state as shown in FIGS. 1 and 2B. In this case, the upper limit position regulation parts 21 of the front end of the key 3 are brought into abutment with a predetermined stopper 20 of the keyboard chassis 2 from below, whereby further pivotal motion of the key 3 is inhibited.

Next, a further detailed description will be given, with reference to FIGS. 3A to 7C, of the key guide structure according to the present invention, focusing on the construction of the white key guide part 11*a* of the chassis front 11 and that of the key 3 to be guided by the white key guide part 11*a*. The key guide structure of the white key 3*a* and the key guide structure of the black key 3*b* are substantially the same, and therefore, the following description will be mainly given of the white key 3*a*.

Figure 4A:
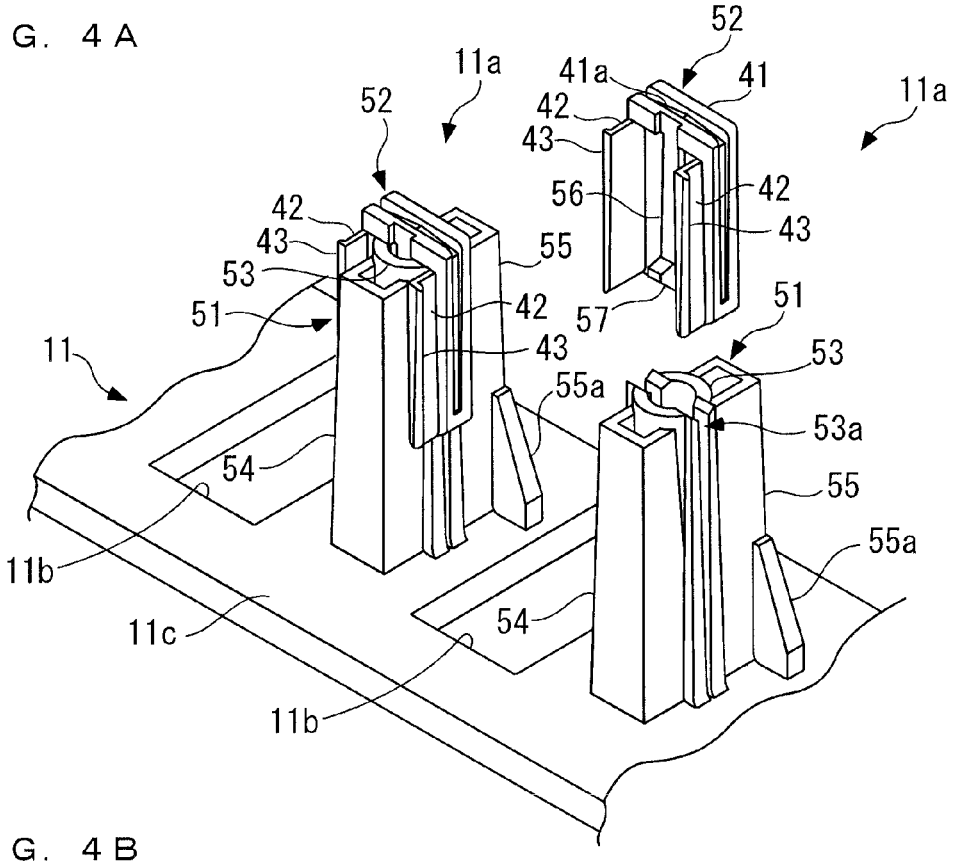
FIG. 4A is a perspective view of white key guide parts in which a left-side one is in a state in which a key guide member thereof has been mounted to a key guide holder associated therewith, and a right-side one is in a state in which a key guide member thereof has been removed from a key guide holder associated therewith.
Figure 4B:
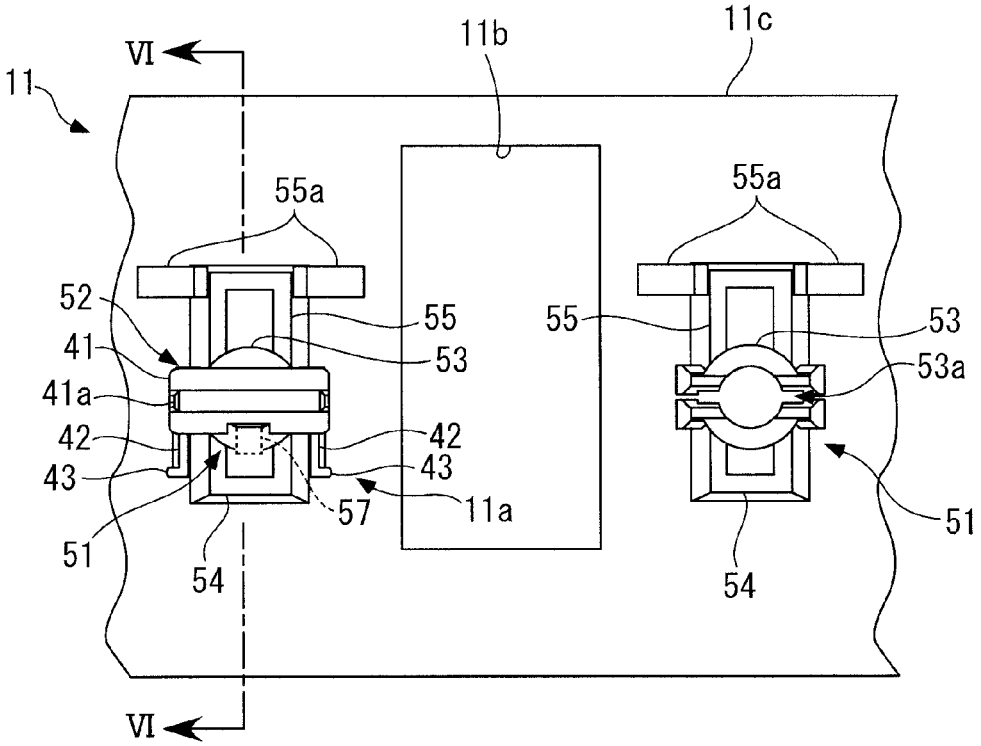
FIG. 4B is a plan view of the white key guide parts shown in FIG. 4A.

FIGS. 4A and 4B show two white key guide parts 11*a* of the chassis front 11. One (left one in FIGS. 4A and 4B) of the white key guide parts 11*a* is in a state in which a key guide member 52, referred to hereinafter, has been mounted thereto, and the other (right one in FIGS. 4A and 4B) of the white key guide parts 11*a* is in a state in which the key guide member 52 has been removed therefrom. As shown in FIG. 4A, each of the white key guide parts 11*a* is comprised of a key guide holder 51 erected on a horizontal flat part 11*c* of the chassis front 11 and the key guide member 52 mounted to the key guide holder 51.

The key guide holder 51 is integrally formed with the keyboard chassis 2, and has a hollow cylindrical holder part 53 extending vertically over a predetermined length and reinforcement parts 54 and 55 erected on the flat part 11*c* in a manner continuous with the front and rear of the holder part 53, respectively. The holder part 53 is provided with a mounting portion 53*a* in the form of a slit extending vertically to open upward and formed through the holder part 53 in the left-right direction, and the key guide member 52 is mounted in the mounting portion 53*a*. Each of the front and rear reinforcement parts 54 and 55 has a U shape, in plan view, open toward the holder part 53. Note that the rear reinforcement part 55 is provided with auxiliary reinforcement parts 55*a* and 55*a* erected on the flat part 11*c* in a manner continuous with the respective left and right side surfaces of the lower half of the rear reinforcement part 55.

On the other hand, the key guide member 52 is made of a soft synthetic resin (e.g. elastomer), and is comprised, as shown in FIGS. 4A to 5D, of a key guide body 41 having a vertically elongated rectangular shape in front view and a predetermined thickness, two left and right flexible portions 42 protruding forward from the respective left and right ends of the front surface of the key guide body 41 and having flexibility in the left-right direction, and two left and right contact portions 43 and 43 formed at front ends of the respective flexible portions 42 in a manner protruding in the left and right directions, respectively, for contact with respective left and right guide walls 61 and 61, referred to hereinafter, of the key 3.

The key guide body 41 has a predetermined lateral width W1, which is set to be smaller than a distance between the left and right guide walls 61 and 61 of the key 3. Further, top and left and right end portions of the key guide body 41 have respective predetermined thicknesses and are formed such that the end portions are thicker than the other portions. The end portions of the key guide body 41 are formed with a groove 41*a* which extends along the periphery. When lubricant, such as grease, is applied to the end portions of the key guide body 41, part of the lubricant enters the groove 41*a* to be held therein. This makes it possible to maintain the state where the grease is held on the left and right side surfaces of the key guide body 41 for a long time, so that lubricity between the left and right guide walls 61 and 61, referred to hereinafter, of the key 3, and the left and right side surfaces of the key guide body 41 can be ensured during key depression.

Further, the key guide body 41 has an insertion portion 56 formed in the center of the front surface thereof in a manner extending vertically for being inserted into the holder part 53 of the key guide holder 51. As shown in FIGS. 5B and 5C, the insertion portion 56 is formed to be relatively thick in the front-rear direction and have a lateral width progressively reduced downward. Furthermore, the insertion portion 56 has a lower end formed with an engagement protrusion 57 protruding forward. The engagement protrusion 57 has an engagement surface 57*a* which extends substantially horizontal and a sloped surface 57*b* which is sloped forward and upward at a location downward of the engagement surface 57*a*.

Figure 5A:
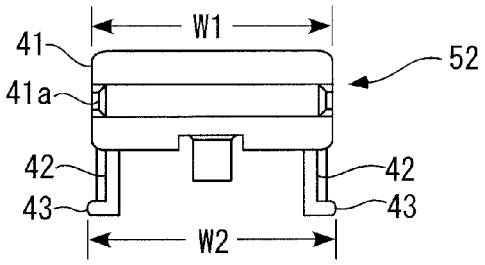
FIG. 5A is a plan view of a key guide member.
Figure 5B:
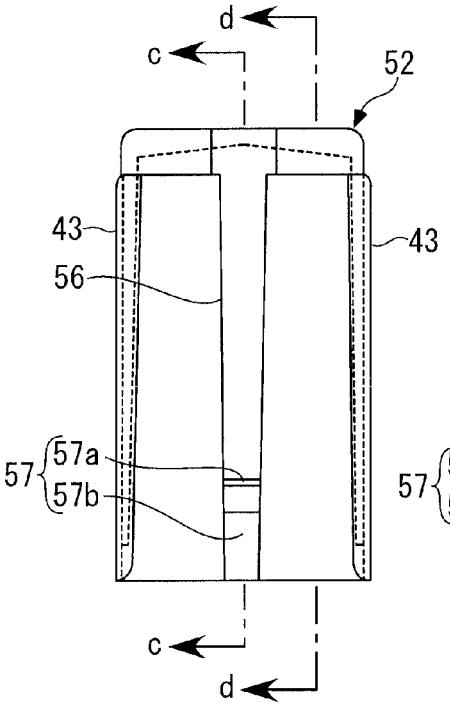
FIG. 5B is a front view of the key guide member.
Figure 5C:
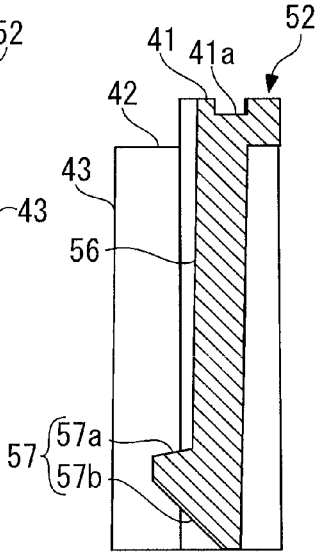
FIG. 5C is a cross-sectional view taken on line c-c of FIG. 5B.
Figure 5D:
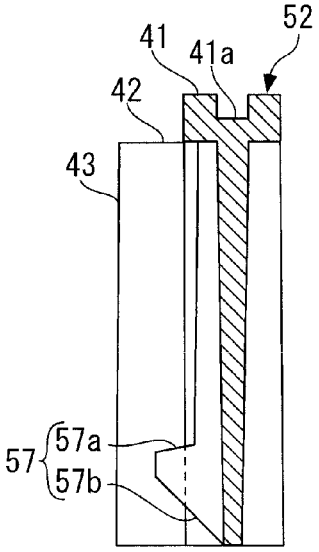
FIG. 5D is a cross-sectional view taken on line d-d of FIG. 5B.

As shown in FIGS. 5A and 5B, the left and right flexible portions 42 and 42 of the key guide member 52 and the left and right contact portions 43 and 43 of the same are formed laterally symmetrically. Specifically, each of the flexible portions 42 and 42 is formed in a thin wall shape having a predetermined thickness (e.g. 0.5 mm) in the left-right direction and has a vertically elongated rectangular shape in side view. On the other hand, each of the contact portions 43 and 43 is formed in a manner extending vertically over the whole length of the front end of the associated flexible portion 42 and protruding outward from an associated one of the left and right side surfaces of the key guide body 41. In short, as shown in FIG. 5A, a distance between ends of the respective left and right contact portions 43 and 43 (hereinafter referred to as "the maximum width W2") is set to be larger than the lateral width W1 of the key guide body 41.

Figure 6:
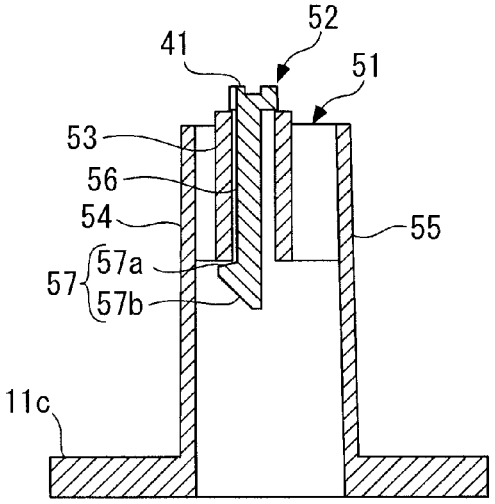
FIG. 6 is a cross-sectional view taken on line VI-VI of FIG. 4B.

In the key guide holder 51 and the key guide member 52 constructed as above, the key guide member 52 is mounted to the key guide holder 51 with the insertion portion 56 in the center of the key guide member 52 being inserted from above into the mounting portion 53*a* of the holder part 53 of the key guide holder 51. In this case, as shown in FIG. 4A, the key guide body 41 of the key guide member 52 is mounted with its top and left and right end portions protruding outward of the holder part 53 of the key guide holder 51. Further, as shown in FIG. 6, the engagement protrusion 57 of the key guide body 41 is positioned below the holder part 53 of the key guide holder 51, and the engagement surface 57*a* of the engagement protrusion 57 is latched by the lower end of the holder part 53. This causes the key guide member 52 to be securely mounted to the key guide holder 51 in a retained state.

Figure 7A:
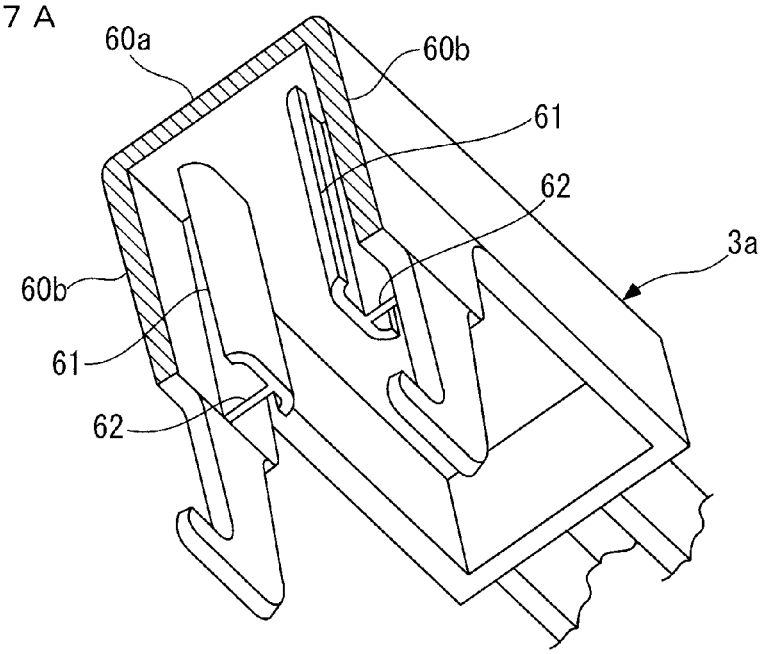
FIG. 7A is a perspective view of a white key having a front end thereof cut off vertically, as viewed from below.
Figure 7B:
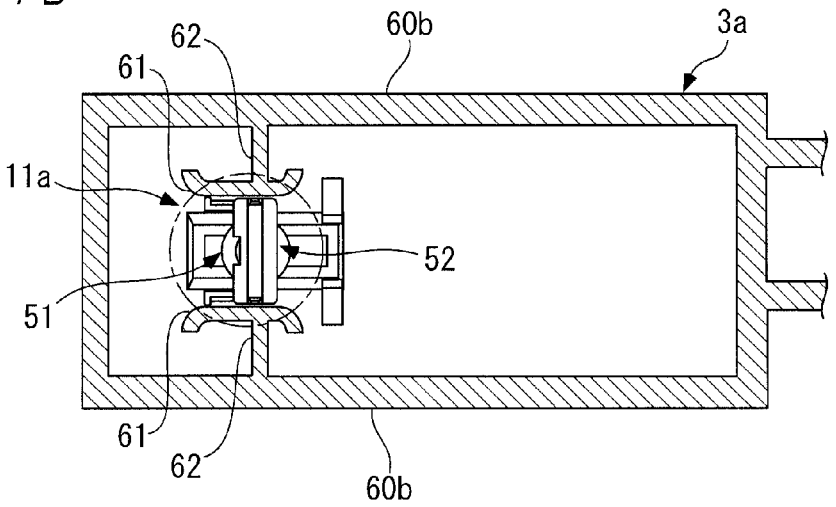
FIG. 7B is a plan view of the white key having an upper portion horizontally cut off, showing a relation between the white key and a white key guide part associated therewith.
Figure 7C:
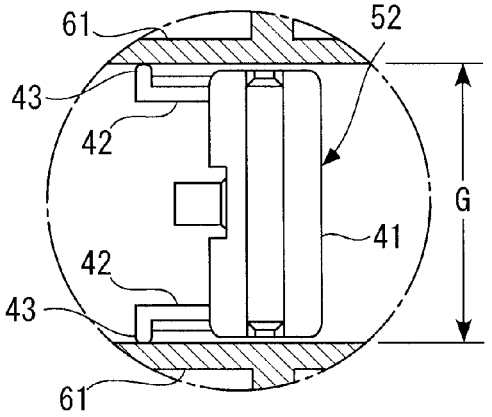
FIG. 7C is an enlarged view of a portion encircled by a one-dot chain line in FIG. 7B.

FIGS. 7A to 7C show a front portion of the white key 3*a*. FIG. 7A illustrates the internal construction of the front portion of the white key 3*a*, and FIGS. 7B and 7C show the relationship between the white key 3*a* and the white key guide part 11*a*. As shown in FIGS. 7A to 7C, in the front portion of the white key 3*a*, there are provided the left and right guide walls 61 and 61 with a predetermined spacing in the left-right direction. Each of the guide walls 61 is integrally formed with the white key 3*a* via a spacer 62 which extends vertically over a predetermined length from a top wall 60*a* of the white key 3*a* and projects inward over a predetermined length from an associated one of side walls 60*b* of the white key 3*a*. A distance G between the left and right guide walls 61 and 61 is set to be larger than the lateral width W1 of the key guide body 41 of the key guide member 52 and equal to or smaller than the maximum width W2 between the left and right contact portions 43 and 43 ($W1<G\leq W2$). Note that the guide walls 61 and 61 form a guide recess of the present invention, which is open downward and with which the key guide member 52 is in sliding contact.

When the white key 3*a* having the left and right guide walls 61 and 61 constructed as above is in the key-released state, the top end of the key guide member 52 is brought into a state slightly inserted from below between the left and right guide walls 61 and 61, and a predetermined clearance (e.g. 0.2 mm) is formed between the key guide body 41 and each of the left and right guide walls 61 and 61. When depressed in the key-released state, the white key 3*a* pivotally moves about the pivot shafts 24 of the rear end thereof to be smoothly guided without lateral swing, with the two guide walls 61 and 61 held in sliding contact with the respective left and right contact portions 43 and 43 of the key guide member 52 of the white key guide part 11*a* or additionally with the respective left and right side surfaces of the key guide body 41 of the white key guide part 11*a* as well.

Although detailed description is omitted, the black key guide part 12*a* for guiding the black key 3*b* has the same key guide member 52 as the key guide member 52 of the white key guide part 11*a*, and the key guide member 52 is configured such that the left and right contact portions 43 and 43 or additionally the respective left and right side surfaces of the key guide body 41 as well are in direct sliding contact with the left and right side walls of the black key 3*b*.

As described in detail heretofore, according to the present embodiment, the key guide body 41 of each of the key guide members 52 has the left and right side surfaces thereof each disposed with the predetermined clearance from the associated one of the two guide walls 61 and 61 of the key 3, and the contact portions 43 and 43 formed at the front ends of the respective left and right flexible portions 42 and 42 of the key guide body 41 are held in contact with the left and right guide walls 61 and 61, respectively. In short, the left and right contact portions 43 and 43 of each key guide member 52 are constantly held in contact with the respective guide walls 61 and 61 of the key 3 with appropriate friction and with a relatively weak force. This makes it possible to suppress generation of noise more effectively than in a case where the left and right guide walls 61 and 61 of the key 3 are directly brought into contact with the key guide body 41 of the key guide member 52 during key depression.

Further, even when the contact portion 43 of the key guide member 52 is pressed by the guide wall 61 of the key 3 during key depression due to variation in manufacturing or mounting of the key guide member 52, the flexible portion 42 formed with the contact portion 43 warp to thereby prevent large friction from being caused between the guide wall 61 and the contact portion 43 of the key guide member 52. This makes it possible to ensure smooth pivotal motion of the key 3 and stably and properly guide the key 3.

Furthermore, although in the present embodiment, a lubricant, such as grease, is applied to the top and left and right end portions of the key guide body 41 of the key guide member 52, even when a less expensive lubricant than a lubricant conventionally used is employed or the amount of lubricant is reduced, the key guide member 52 can provide a sufficient effect as a key guide while preventing generation of noise.

Note that the present invention is not limited to the above-described embodiment, but can be practiced in various forms. For example, although in the above-described embodiment, the key guide member 52 is provided with the left and right flexible portions 42 and 42 formed at the respective left and right ends of the front surface of the key guide body 41 in a manner protruding forward, the left and right flexible portions 42 and 42 may be formed at the respective left and right ends of the rear surface of the key guide body 41 in a manner protruding rearward. In this case as well, it is possible to obtain the same effects as provided by the left and right flexible portions 42 and 42 and the contact portions 43 and 43 in the above-described embodiment.

Further, the detailed construction, material, etc. of each of the key guide holder 51, the key guide member 52, and the key 3 which constitute the key guide structure of the embodiment of the present invention are described only by way of example, and therefore these can be changed, as desired, within the scope of the subject matter of the present invention.

What is claimed is:

1. A key guide structure for a keyboard instrument having a front side and a rear side and including a plurality of keys each of which extends in a front-rear direction with a rear end thereof pivotally supported on a keyboard chassis and with a guide recess opening downward, the key guide structure being provided for guiding each key pivotally moved by key depression, the key guide structure comprising:

a plurality of key guide holders each erected on the keyboard chassis, in association with each key, at a location below the guide recess; and a plurality of key guide members mounted to upper portions of said key guide holders, respectively, each for being brought into sliding contact with left and right inner side surfaces of the guide recess, wherein each of said key guide members comprises:

a key guide body formed in a plate shape which is rectangular as viewed from a front side and has a predetermined thickness, said key guide body being disposed between the left and right inner side surfaces of the guide recess with a predetermined clearance from each of the left and right inner side surfaces, a left flexible portion and a right flexible portion which are flexible in a left-right direction and extend from respective left and right ends of one of a front surface and a rear surface of said key guide body in a manner protruding in the front-rear direction, and a left contact portion and a right contact portion provided at respective front ends of said flexible portions in a manner protruding sideward therefrom, and in contact with the left and right inner side surfaces of the guide recess, respectively.

2. The key guide structure according to claim 1, wherein said key guide member is made of a soft synthetic resin, and wherein each of said flexible portions is formed in a thin wall shape having a predetermined thickness in the left-right direction.

3. The key guide structure according to claim 1, wherein each of said flexible portions and each of said contact portions extend vertically, and wherein each of said contact portions is capable of being in contact with the inner side surface of said guide recess over an entire vertical length thereof.

4. The key guide structure according to claim 2, wherein each of said flexible portions and each of said contact portions extend vertically, and wherein each of said contact portions capable of being in contact with the inner side surface of said guide recess over an entire vertical length thereof.

* * * * *